US010760237B2

(12) United States Patent
Birtele

(10) Patent No.: US 10,760,237 B2
(45) Date of Patent: Sep. 1, 2020

(54) METHOD FOR OPTIMIZING PROCESSES FOR INCREASING THE LOAD-BEARING CAPACITY OF FOUNDATION GROUNDS

(71) Applicant: THUR S.R.L., Verona (IT)

(72) Inventor: Andrea Birtele, Verona (IT)

(73) Assignee: THUR S.R.L., Verona (IT)

( * ) Notice: Subject to any disclaimer, the term of this patent is extended or adjusted under 35 U.S.C. 154(b) by 0 days.

(21) Appl. No.: 16/309,841

(22) PCT Filed: Jun. 21, 2017

(86) PCT No.: PCT/EP2017/065287
§ 371 (c)(1),
(2) Date: Dec. 13, 2018

(87) PCT Pub. No.: WO2018/001833
PCT Pub. Date: Jan. 4, 2018

(65) Prior Publication Data

US 2019/0194897 A1 Jun. 27, 2019

(30) Foreign Application Priority Data

Jun. 27, 2016 (IT) ..... 102016000066045

(51) Int. Cl.
*E02D 3/12* (2006.01)
*E02D 37/00* (2006.01)
*E02D 5/46* (2006.01)

(52) U.S. Cl.
CPC ..... *E02D 3/12* (2013.01); *E02D 5/46* (2013.01); *E02D 37/00* (2013.01)

(58) Field of Classification Search
CPC ..... E02D 3/12; E02D 5/46; E02D 37/00
See application file for complete search history.

(56) References Cited

U.S. PATENT DOCUMENTS 2,627,169 A 2/1953 Poulter
5,377,104 A * 12/1994 Sorrells ..... E21B 41/0057 702/11
2005/0158128 A1* 7/2005 Canteri ..... E02D 3/12 405/266
2009/0155002 A1* 6/2009 Hakkinen ..... E02D 3/12 405/263
2013/0011206 A1* 1/2013 Occhi ..... E02D 1/02 405/263

FOREIGN PATENT DOCUMENTS

DE 19521639 A1 5/1996
EP 0851064 A1 7/1998
EP 1914350 A1 4/2008
EP 2543769 A1 1/2013

OTHER PUBLICATIONS

International Preliminary Report on Patentability dated Jun. 13, 2018 re: Application No. PCT/EP2017/065287, pp. 1-14, citing: U.S. Pat. No. 2,627,169 A and DE 195 21 639 A1.
International Search Report dated Aug. 1, 2017 re: Application No. PCT/EP2017/065287, pp. 1-3, citing: U.S. Pat. No. 2,627,169 A and DE 195 21 639 A1.
IT Search Report dated Mar. 21, 2017 re: Application No. UA20164665, pp. 1-7, citing: U.S. Pat. No. 2,627,169 A and DE 195 21 639 A1.
Written Opinion dated Aug. 1, 2017 re: Application No. PCT/EP2017/065287, pp. 1-3, citing: U.S. Pat. No. 2,627,169 A and DE 195 21 639 A1.

* cited by examiner

*Primary Examiner* — Tara Mayo-Pinnock
(74) *Attorney, Agent, or Firm* — Cantor Colburn LLP

(57) ABSTRACT

A method for optimizing processes for increasing the load-bearing capacity of foundation grounds includes the following steps:

detecting at least one part of a built structure and/or of ground;

identifying at least one region to be treated of the foundation ground;

and injecting, at least one injection point located substantially within the at least one region to be treated, a cement and/or synthetic mixture. The method further includes at least one second step of detecting at least one part of the built structure and/or of the ground that lies above the injected foundation ground. The method further includes a step of interrupting the injection step, and measuring at least one physical parameter that is susceptible of varying as a consequence of the injection step.

12 Claims, No Drawings

METHOD FOR OPTIMIZING PROCESSES FOR INCREASING THE LOAD-BEARING CAPACITY OF FOUNDATION GROUNDS

TECHNICAL FIELD

The present disclosure relates to a method for optimizing processes for increasing the load-bearing capacity of foundation grounds and, specifically, for identifying the best possible position of the injection points and defining the optimal amount of cement and/or synthetic mixtures in injection operations aimed at improving the hydraulic or mechanical characteristics of the grounds.

BACKGROUND

Any built structure transmits pressures to the ground which produce deformations in the ground that will emerge in the long teen, known as subsidence.

When at the base of two points of the same built structure the subsidences are different, the difference between the values measured is called a differential subsidence.

Usually differential subsidences of the ground at the base of built structures are not very significant and do not result in deformations of the structure that are such as to show cracks, collapses or malfunctions in general.

However, there are cases where the differential subsidences of the ground produce shifts of the overlying built structure that are such as to cause fractures in the structure, often non-negligible. These are cases where the ground is particularly deformable by the pressures transmitted by built structures, or cases where the built structures are constituted by fragile materials.

The method usually used to deal with this kind of problem, at the design phase of the built structure, or on existing built structures, involves a two-pronged analysis, of the foundation ground and the structure of the built structure.

The first analysis evaluates the nature and the texture of the ground and as a consequence makes it possible to calculate its resistance and deformability with respect to the loads of the built structure.

The second analysis examines the possible differential movements as a function of the type of structure planned in the design, or it reconstructs in detail the differential movements of the existing structure that have created the cracks present on the built structure, both in terms of time and in terms of geometry.

For the analysis of the ground, the designer can avail of traditional geotechnical tests, both on-site and in the laboratory, or of geophysical tests, which have recently been introduced on the market. The method derives substantially from traditional geotechnics and involves calculating the resistance and the deformability of the ground with respect to the pressures produced on the ground by the foundations of the built structure, starting from the geotechnical parameters gleaned from the texts.

The analysis of the built structure follows two different paths.

For buildings still to be built, the shifts are calculated according to the specifications of building science, optionally availing of digital models.

For existing buildings, the analysis of the built structure is much more comprehensive and complex than the one above, and uses measurement instruments associated with topography and with structural monitoring. Often leveling is carried out with precision instrumentation in order to verify which part of the built structure has subsided and the extent of the displacement. The topographic readings are then fleshed out by monitoring using crackmeters, inclinometers, strain gauges etc., the aim of which is to verify whether the subsidence is evolving and with what speed.

After completing the analysis on the foundation ground and on the structure of the built structure, the designer defines the most suitable method for resolving the differential subsidences.

There are various systems for preventing or resolving differential subsidences. They are divided into systems that act on the structure and systems that treat the ground.

The first systems seek to modify how the pressures of the built structure are transferred to the ground through works adapted to widen the base of the foundation or to deepen it in the ground until it meets strata that are more substantial therefore resistant. The methods in question are generally applied to the entire structure: these systems include, for example, micropiles and underpinning.

The second systems seek to improve the characteristics of resistance and deformability of the ground through actions aimed at densifying the mass or at introducing materials or mixtures into it that physically or chemically modify the characteristics of the natural ground. These methods can be limited to some portions of the built structure, where the ground has poorer characteristics. This category includes, among others, injections of cement and/or of synthetic resins.

Among the various known methods for treating the ground to resolve differential subsidences by way of injections, is for example the method described by EP0851064, which entails increasing the load-bearing capacity of foundation grounds for buildings by way of injecting a substance that expands following a chemical reaction. The method disclosed includes verification of the effectiveness of the measure, by way of using laser receivers fixed to some points of the structure overlying the injected volume which, connected to an emitter, report the vertical shifts of the built structure following the expansion of the substance in the ground.

There are other methods that involve the injection of mixtures of differing nature. One of these is the Soilfrac technology developed by the Keller Grundbau company, which entails the use of mixtures of cements and expanding cements. The method creates fractures in the ground in multiple steps, using the mixture which is injected by way of a pump that develops medium-to-high pressures. In this case too, shifts of the building or of the ground overlying the injection are monitored by way of levelometer systems that make it possible to observe the relative movement of some points of the built structure with respect to others, using the principle of communicating vessels.

The aim of the monitoring systems described that are availed of by the known methods is to indirectly evaluate the effectiveness of the intervention, i.e. they detect consolidation occurring in the ground through observation of the movement of the structure overlying the treated point, or of the surface of the ground.

The methods described, although indirect, are very widely used because they are immediate and low cost and they do not entail invasive measures in the ground.

Both of the systems described have limitations, however, which are due to the fact that the rise of the built structure or of the surface of the ground overlying the injection, although necessary, is not always sufficient to ensure the adequate improvement of the entire volume of ground affected by the loads of the structure.

It can in fact happen that the building or the surface of the ground registers a rise owing to overpressures of water contained in the gaps of the ground, but this is not sufficient to ensure adequate values of load-bearing capacity in the long term. It can further transpire that the rise of the built structure or of the surface of the ground is due to the pressures that the injected mixture exerts at a certain depth in the ground, but this is not an indicator of complete improvement of the volume of ground present throughout the vertical underlying the point being monitored.

The vertical movement of the building as a result of the injections depends greatly on the weight and on the rigidity of the structure. Smaller buildings with mostly isostatic constraints are affected locally by pressures in the ground, while larger buildings with more complex and rigid structures are less likely to rise, since larger portions of the structure are affected. It is especially with this latter type of building that the criterion of effectiveness means it is not possible to evaluate the homogeneity of the treatment of the ground with precision. In fact it can happen that an entire portion of built structure rises uniformly, even if in reality the consolidation obtained with the injections does not affect the entire volume of ground but only a reduced portion of it.

In order to overcome this indeterminacy dictated by the imprecision of the indirect measurement method, the measures carried out on rigid structures, but also on other structures, are generally overdimensioned, i.e. they follow very dense injection geometries that rely on the overlapping of the effects since they are not perfectly controllable.

In order to obtain the improvement of the mechanical and hydraulic characteristics of all of the treated volume of ground, the methods that avail of indirect evaluation of effectiveness by observing the movement of the structure overlying the treated point or of the surface of the ground force the designers to follow non-optimal distribution criteria of the injections, with consequent increase of the cost and time for carrying out the work.

Furthermore, even after carrying out a superabundant number of injections with respect to the number theoretically necessary, and even after injecting an amount of cement and/or synthetic mixture that produces a rise, possibly major, of the overlying built structure, it is not certain that the improvement of the mechanical and/or hydraulic characteristics of the ground will be homogeneous as described earlier.

In fact, the rise could be determined by a temporary increase in the pressure of the water contained in the gaps of the ground, or it could be determined, in areas farther away from the injection point, by the rigidity of the structure and it may therefore not be a good indicator of effectiveness of the injections.

Furthermore, the detection of the rise during the injection step is done exactly, generally with a laser level that measures the vertical displacement of a point of the structure. Such point can be above or below a crack, resulting in a signal that is sometimes deceptive.

The volume of influence of the injection of cement and/or synthetic mixture strictly depends, in addition to on the type of mixture, which may or may not be expanding, on the amount of mixture dispensed, on the physical and mechanical characteristics of the ground, and on the injection parameters such as the pressure and the temperature.

Other methods of consolidating ground are known, although they differ from the ones described here; they use systems of controlling the injections of chemical substances into the ground by way of geoelectrical surveys. An example of this is the method described in European patent EP1914350 which involves the use of 3D tomography of the electrical resistivity of the ground in comparative form, i.e. carried out both in the ground that is not affected by subsidence phenomena and in subsided portions. In this case, the aim of the electrical tomographic measurement in the natural ground that has not subsided has the aim of defining the electrical resistivity values to take as a reference for the operation to consolidate the ground, while the tomography carried out in the ground affected by subsidence has the aim first of all of defining a starting value and subsequently of checking the evolution of the resistivity values during the injections, which will need to lean towards the values measured in the area that has not subsided.

Such system however presents clear limitations which can briefly be summed up in the following points. The area on which it is decided to monitor the reference electrical resistivity, presumed to be an area not affected by subsidence, can in reality present problems of poor load-bearing capacity and therefore it can lead the operator to set target electrical resistivity values that are incorrect. In effect there can be portions of the building that are not hit by instability which in reality stand on areas of ground that do not have sufficient load-bearing capacity, but which remain integral because they are very strong and rigid.

The case can also arise where the entire building is hit uniformly by instability and therefore it is not possible to define the reference electrical resistivity value.

In the same way, it is impossible to compare electrical resistivity values if the portion of building that has subsided stands on grounds of a different nature from those in the portion that has not subsided, or where the geometry of the foundations is evidently different between the various portions.

There is further a frequent type of case where the subsidence is linked to phenomena of drying of clayey ground. In this case the reference tomography, i.e. the tomography carried out on the area that has not subsided, will from the beginning have lower resistivity values than those of the subsided portion. Therefore, any injection operation carried out in the subsided area which improves the resistivity of the ground cannot make the measured values lean towards the reference values.

In all the cases examined, however, the electrical resistivity values measured do not make it possible to evaluate the efficacy of the operation because they are limited to describing a parameter associated with the electrical properties of the ground, which is very different from the mechanical parameters used to evaluate the state of consolidation.

The method described further does not use a system for controlling shifts of the building and therefore it does not ensure the required safety during the injection step. It can happen in fact that the treatment of the ground by way of injection, aimed only at varying the electrical resistivity, can produce shifts of the overlying built structure which are such as to induce angular distortions in the structure which are greater than the tolerances allowed.

Angular distortions are defined as the ratio between the differential vertical displacement between two points of the same built structure (differential subsidence or differential lifting) and their minimum distance. The skilled person is always capable of determining the admissible tolerances with the help, for example, of some tables that contain the admissible and limit values for the angular distortions as a function of the type of building. By way of non-exhaustive example, below are the most significant:

Limit Values for Angular Distortions According to Bjerrum (1963)

| Category of potential damage | tanβ |
|---|---|
| Limit beyond which problems can arise in machinery sensitive to subsidences | 1/750 |
| Danger limit for space frame structures | 1/600 |
| Safety limit for buildings in which no cracking is admitted | 1/500 |
| Limit beyond which the first cracks can appear in dividing walls and difficulty in use of bridge cranes | 1/300 |
| Limit beyond which inclinations in tall buildings can be visible | 1/250 |
| Considerable cracks in dividing walls and supporting brick walls | 1/150 |
| Safety limit for supporting brick walls with h/L < 1/4 | 1/150 |
| Limit beyond which structural damages is to be expected in buildings | 31/12/49 |

Admissible Angular Distortions According to Sowers (1962)

| Type of structure | tanβ |
|---|---|
| Multistory load-bearing walls | 0.0005 ÷ 0.001 |
| Single-story load-bearing walls | 0.001 ÷ 0.02 |
| Plaster cracks | 0.001 |
| Reinforced concrete frames | 0.0025 ÷ 0.004 |
| Walls of reinforced concrete frame structures | 0.003 |
| Steel frames | 0.002 |
| Simple steel structures | 0.005 |

The admissible angular distortion values for the built structure under study are defined at the design stage.

Application of a method of consolidating the ground that does not make use of a system of monitoring the built structures overlying the treated volumes of ground is therefore excessively risky and certainly lacking control.

Another conventional method that uses 3D tomography of electrical resistivity in consolidation of the ground is the method described in EP2543769 which entails consolidation of the ground and the simultaneous sequential use of electrical tomography. The aim of the geophysical survey in this case is to quantify the value of electrical resistivity in order to provide the operator with indications on the criterion for interrupting the injection. The method in fact indicates as a criterion for stopping the injection the moment when, between two successive injections, the variation in electrical resistivity acquired by tomography is lower than 5%.

In this case too the method exhibits limitations. Consider for example the case where the ground has subsided owing to drying and is therefore in conditions of very low humidity. The value of resistivity measured in the initial step, as mentioned, is very high and therefore it can happen that the subsequent value measured after the first injection only will have increased by a percentage of less than 5% with respect to the initial value measured. In this case the method requires stopping the injection, even if sufficient consolidation of the ground has not been achieved.

Of further note, also in this case, is the absence of monitoring of the building, which does not give adequate safety assurances during the injection step against the development of admissible angular distortions on the structure.

The monitoring of the variation of resistivity in a volume of ground entails changes that are different from point to point. There are in fact points where the variation is marked and others where it has little significance. The method described does not specify which are the volumes to consider in applying the efficacy criterion or whether the reference value is the average. Also in this case, the fact remains that the method is based exclusively on an evaluation linked to the electrical properties of the ground which represent an indirect and imprecise measurement of the mechanical characteristics of the ground.

Finally, while the methods of ground consolidation that avail only of the system of measuring the electrical resistivity on the one hand make it possible to identify at least approximately the volume of ground that is affected by the effects of the injections, on the other hand they cannot evaluate the intensity thereof that is necessary to ensure the improvement of the mechanical characteristics.

In fact, it can happen that even defining a spatial distribution of the injections that makes it possible to obtain a significant variation in electrical resistivity of the volume treated, with the consolidation methods described it is not possible to define the correct amount of cement and/or synthetic mixture to be used for the individual injections in order to obtain the desired consolidation and prevent excessive angular distortions on the built structures on the surface.

SUMMARY

The aim of the present disclosure is to solve the above mentioned problems by providing a method that is capable of identifying the best possible position of the injection points and defining the optimal amount of cement and/or synthetic mixtures in the injection operations aimed at improving the hydraulic or mechanical characteristics of the grounds.

Within this aim, the present disclosure provides a method that integrates the systems of monitoring the building by way of a system for controlling the ground with geoelectrical surveys such as for example 2D or 3D electrical tomography.

The present disclosure provides a method that is low cost and simple and rapid to carry out.

This aim and these and other advantages which will become better apparent hereinafter are achieved by providing a method according to claim 1.

DETAILED DESCRIPTION OF THE DISCLOSURE

Further characteristics and advantages of the present disclosure will become better apparent from the description of some preferred, but not exclusive, embodiments of the method according to the disclosure.

The present disclosure relates to a method for optimizing processes for increasing the load-bearing capacity of foundation grounds, which comprises:

- a first step of detecting at least one part of a built structure and/or of ground;
- a step of identifying at least one region to be treated of the foundation ground that lies below at least one portion of the at least one part of the built structure and/or of ground;
- a step of injecting, at at least one injection point located substantially within the at least one region to be treated, a cement and/or synthetic mixture;
- at least one second step of detecting at least one part of the built structure and/or of the ground that lies above the injected foundation ground;

a step of interrupting the injection step upon the detection of an upheaval movement of at least one portion of the built structure and/or of the ground that lies above the foundation ground;

a step of measuring at least one physical parameter that is susceptible of varying as a consequence of the injection step substantially at the volume of ground affected by the injection step;

a step of identifying the optimum spatial distribution of the successive injection points as a function of the values and of the spatial distribution of the at least one physical parameter measured in the measurement step.

In particular, such method is adapted to identify the best possible position of the injection points and to define the optimal amount of cement and/or synthetic mixtures to be injected at such points in the injection operations aimed at improving the hydraulic or mechanical characteristics of grounds.

Conveniently, the physical parameter is selected from the group comprising:

electrical resistivity;

seismic wave propagation speed;

gravitational acceleration.

Conveniently, the step of identifying the optimum spatial distribution of the injection points is determined by considering that the volume of ground improved with the injection corresponds to the volume of ground in which values of electrical resistivity at least 5% higher than those measured in the vicinity of that same volume of ground are observed.

Preferably, the variation of the above mentioned physical parameter is measured before and after the injection step.

The step of identifying the optimum spatial distribution of the injection points is determined by considering that the volume of ground improved with the injection step corresponds to the volume of ground in which values of electrical resistivity are observed at least 5% higher than those present in the same volume of ground before the injection step.

It is possible that the step of identifying the optimum spatial distribution of the injection points is determined by considering that the volume of ground improved with the injection corresponds to the volume of ground in which values of electrical resistivity that are higher than a predefined value are observed.

The method comprises a step of storing the amount of cement and/or synthetic mixture that is injected in the first step of injection: in particular, the amount of injected mixture corresponds to the amount of cement and/or synthetic mixture that is necessary in order to produce, in the injection step, a displacement of the built structure and/or overlying ground of at least 0.1 mm.

In this regard, the amount of cement and/or synthetic mixture to be injected into the injection points identified in the identification step corresponds substantially to the amount injected in the injection step before the step of stopping the injection.

Preferably, the scanning of the built structure is carried out by way of using at least one one-, two- or three-dimensional laser scanning device, or with radar systems.

Advantageously, the reconstructions performed by way of laser scanning devices or by way of radar systems are digital.

Such scanning device can comprise a 3D laser scanner detector or a radar system such as ARAMIS (Advanced Radar for Microwave Interferometric Surveys) to be positioned in proximity to the built structure, at a point that allows the scanning of the entire facade or of a part thereof (or of a portion of floor) below which the injection of the ground will be carried out, with mixtures under pressure or expanding resins.

Once the 3D laser scanner system or ARAMIS is positioned, one or more scans of the facade (or of the floor) are carried out in order to record the state of consistency of the built structure before the injections are begun. There is no reason why the first scanning step and/or the second scanning steps cannot be carried out by other types of scanning devices such as for example a laser level.

It is likewise possible for the first and/or the second scanning step to be carried out by an emitter/receiver device of electromagnetic waves and/or of sound waves or by similar devices.

The method proceeds with executing a hole or a plurality of holes, vertical or inclined with respect to the vertical, in the ground or even through the foundation of the built structure, of diameter that can vary from 6 mm to 200 mm. The initial geometry with which the hole or the holes are distributed below the built structure is determined by a computer model or in simpler cases by experience. Usually the depth of these holes is a function of the characteristics of the foundation ground and is usually comprised between the depth corresponding to the intrados of the foundation and 15-20 meters from that intrados and their center distance is usually comprised between 0.50 and 3.0 m.

Subsequently, pipes are accommodated in the hole or holes and the mixtures and/or the synthetic resins are injected into the ground through these pipes.

The cement and/or synthetic mixtures are injected into the ground through pressure pumping systems, which force the entry of the mixtures into the intergranular spaces or, in grounds with finer texture, produce hydraulic fracturing, i.e. the local breakage of the ground and the formation of grids of mixture that, once hardened, improve the mechanical characteristics of the mass. The pumping systems for the cement and/or synthetic mixtures dispense flow rates of the order of 5-30 liters per minute and usually develop pressures comprised between 10 and 30 bar. These pressures are capable of forcing the entry of the cement and/or synthetic mixture into the intergranular spaces of sandy and gravelly grounds and of enabling the cement and/or synthetic mixture to access silty or clayey grounds through local breaks called hydraulic fractures.

The cement and/or synthetic mixtures, further, can be injected into the ground through high or very high pressure pumping systems (from 200 to 400 bar), which break up the existing ground and enable the remixing of the matrix with the mixture. This latter system is called jet grouting.

The expanding cement and/or synthetic mixtures are injected into the ground through low-pressure pumping systems. The entry of the expanding cement and/or synthetic mixtures into the intergranular spaces of coarser grounds or the hydraulic fracturing of finer-textured grounds occurs by virtue of the pressure that develops during the step of expansion which, usually, occurs by chemical reaction, reaching values comprised between 0.5 bar and 150 bar. In finer-textured grounds, the process of hydraulic fracturing is produced by the same pressure of expansion of the cement and/or synthetic mixture. The subsequent hardening of the mixture spread through the ground produces the improvement of the geotechnical characteristics.

The diffusion of the cement and/or synthetic mixtures in the grounds, be they expanding or non-expanding, produces the compaction of the ground surrounding the injection points with consequent displacement of the matrix, reduction of intergranular spaces, and expulsion of water. The dimension of the portion of ground affected by the compaction depends mainly on the amount of cement and/or synthetic mixture dispensed as well as on the characteristics of the ground. During the injection process, as the dispensing proceeds of the cement and/or synthetic mixture into a point in the ground, the surrounding volume affected by the compaction gradually increases radially starting from the injection point until vertical displacements are generated of the surface of the ground and of any built structure overlying it, which can be detected with the monitoring system. The vertical movement of the built structure or of the surface of the ground following the injection indicates that the amount of cement and/or synthetic mixture dispensed up to that moment is sufficient to produce an adequate consolidation of the ground for the loads in play.

However, within the possible modes of diffusion of the cement and/or synthetic mixtures, be they linked to the pressure of a pumping system or to expansion by chemical reaction, it is known that the path and the location follow criteria that at the moment cannot be determined. It can happen therefore that the cement and/or synthetic mixtures injected, although producing a rise of the built structure or of the overlying ground, do not occupy the intended design volumes, but migrate to areas where their action may not be needed or even where their presence could aggravate the situation or cause unwanted effects.

It can also happen that the rigidity of the built structures built on the surface produces vertical displacements of portions overlying volumes of ground that are not adequately compacted. To monitor the effectiveness of the method of consolidating the ground by way of injection of cement and/or synthetic mixtures, the building monitoring system is therefore necessarily integrated with the 2D or 3D electrical tomography, which returns almost in real time the path of the cement and/or synthetic mixtures in the ground by detecting the variation of electrical resistivity.

The aim of a geoelectrical survey is to indirectly reconstruct the electrical properties of a given medium and, in particular, of the electrical resistivity, the converse of electrical conductivity. Electrical resistivity is an intrinsic characteristic of a material that directly influences the flow of current, which flows with greater ease in regions of the material that are characterized by low resistivity, and vice versa.

A material characterized by high resistivity values (low conductivity) is said to be resistive, and, as a consequence, a material with low resistivity (high conductivity), is said to be conductive.

The geoelectrical method is by nature indirect and involves, in general, generating an electrical potential field created by the injection of current through two metal electrodes driven into the material to be investigated. These two electrodes are called current dipoles.

By measuring the electrical potential difference (voltage) through a pair of electrodes (referred to as a potential dipole), it is possible to relate the measured voltage to the current introduced. Such ratio is referred to as resistance, which is converted to apparent resistivity by way of a geometric factor that takes account of the reciprocal arrangement of the electrodes.

The distance between the electrodes and the configuration used influence the depth and the spatial resolution of investigation.

The apparent resistivity is an average value of the volume of ground affected by the measurement, and therefore it can deviate from the real value if heterogeneities are present.

To overcome this problem, an operation called electrical tomography is carried out, which involves the acquisition of a dataset of apparent resistivity covering the affected region in a spatially uniform manner.

The data acquired are processed by virtue of specific inversion software, which makes it possible to find the distribution of resistivity, which best approximates the experimental data in a finite element model below the measurement electrodes. The estimate is made by way of an iterative process of minimization (least squares or least absolute values).

The tomography investigation is conducted by positioning in the ground, proximate to the volume to be investigated, starting from the surface, a number of electrodes comprised between 8 and 72 according to regular spreads with a center distance comprised between 0.3 m and 1.5 m.

The dataset is usually acquired at the end of the injection operations. The apparent/inverted resistivity differences between the treated volume of ground and the surrounding ground untreated by injections represent the volume of ground within which the cement and/or synthetic mixture has diffused over the course of the preceding injection step.

It can sometimes be necessary to acquire datasets on two steps, which relate to the starting condition (step 0) in the pre-injection situation and, upon conclusion of the work site activity, the post-injection condition (step 1).

In this case the background acquisition (step 0) relates to the pre-injection step, and best represents the geoelectrical characteristics of the site, while step 1 describes the final status of the operation, after completion of the injections under the affected foundations.

In this case the volume of ground within which the mixture has diffused over the course of the injection process can be identified by analyzing the differences in apparent/inverted resistivity between the configurations of step 1 with respect to step 0.

Among the instruments used for acquisition are the P.A.S.I. Polares frequency modulable alternating current georesistivity meter, and the Electra frequency modulable direct current georesistivity meter produced by Micromed.

The data acquired are then processed according to a procedure that entails the 2D or 3D inversion of the dataset relating to each step analyzed by way of dedicated software and calculation of the differences from the conditions present outside the treated volume or in step 0.

From 2D or 3D reconstructions of the resistivity volume underlying the built structure or the ground surface, it is possible to identify the zones influenced by the injection.

After the injection of the cement and/or synthetic mixtures into the ground and after the consequent detection of the displacement of the built structure or of the surface of the ground overlying the treated volume and at the end of the electrical tomography readings of the improved ground, comes the step of reexamination of the process.

The reexamination step entails the analysis of the amount of cement and/or synthetic resin mixture dispensed in the individual injection points in order to obtain the vertical displacement of the built structure or of the surface of the ground overlying the injection and the evaluation of the volumes of diffusion of the cement and/or synthetic resin mixture in the various injected points.

If the reexamination step confirms that consolidation has been achieved for all the points of the volume underlying the portion of built structure or of ground surface to be treated, then the design technician assesses, based on the readings obtained, the advisability of increasing the distance between the injection points while keeping the amount of cement and/or synthetic resin mixture per single injection unaltered. Differently, the technician analyzes the possibility of increasing the number of injections, globally or locally, and/or of increasing the amount of cement and/or synthetic resin mixture per single point.

The injection step corresponds to an injection in a single injection point of cement and/or synthetic mixtures.

In any case it is possible that the injection step corresponds to multiple injections, which may or may not be simultaneous, of cement and/or synthetic mixtures distributed in a volume of ground.

The step of measuring the electrical resistivity of the ground after the injection step is carried out in a spherical neighborhood of the injection point with a radius of more than one meter.

The optimum spatial distribution of the injections corresponds to a two-dimensional or three-dimensional grid that has a distance between the injection points that is equal to or smaller than twice the minimum distance between the injection point and the external surface of the volume of ground that is improved.

The spatial distribution of the injection points is preset in the design phase: the step of identification of the optimum spatial distribution is suitable to determine the amount of cement and/or synthetic mixture to be injected in each point and/or to increase or decrease the injection points, creating new ones or leaving some unused.

In practice it has been found that the method according to the disclosure fully achieves the aim of identifying the best possible position of the injection points and defining the optimal amount of cement and/or synthetic mixtures in the injection operations aimed at improving the hydraulic or mechanical characteristics of the grounds at low cost, simply, rapidly, effectively and definitively, by integrating the systems for monitoring the built structure with systems for monitoring the electrical resistivity of the ground.

The integration between the system for monitoring the built structure, which constitutes a necessary criterion for the effectiveness of the operation, and control by way of 2D or 3D electrical tomography makes it possible to obtain the assurance of complete and homogeneous treatment of the volume of ground underlying the built structure.

The disclosures in Italian Patent Application No. 102016000066045 (UA2016A004665) from which this application claims priority are incorporated herein by reference.

The invention claimed is:

1. A method for optimizing processes for increasing the load-bearing capacity of foundation grounds, the method including the following steps:

a first step of detecting at least one part of a built structure and/or of ground;

identifying at least one region to be treated of the foundation ground that lies below at least one portion of said at least one part of the built structure and/or of ground;

injecting, at at least one injection point located substantially within said at least one region to be treated, a cement and/or synthetic mixture;

at least one second step of detecting at least one part of the built structure and/or of the ground that lies above the injected foundation ground;

interrupting said injection step upon the detection of an upheaval movement of at least one portion of the built structure and/or of the ground that lies above said foundation ground;

measuring at least one physical parameter that is susceptible of varying as a consequence of said injection step substantially at the volume of ground affected by said injection step; and identifying an optimum spatial distribution of the successive injection points as a function of the values and of the spatial distribution of said at least one physical parameter measured in said measurement step;

said at least one physical parameter being chosen from the group consisting of:

electrical resistivity;

seismic wave propagation speed; and gravitational acceleration, wherein the optimum spatial distribution of the injections corresponds to a two-dimensional or three-dimensional grid that has a distance between the injection points that is equal to or smaller than twice the minimum distance between the injection point and the external surface of the volume of ground that is improved.

2. The method according to claim 1, wherein said step of identifying the optimum spatial distribution of the injection points is determined by considering that the volume of ground improved with the injection corresponds to the volume of ground in which values of electrical resistivity at least 5% higher than those measured in the vicinity of that same volume of ground are observed.

3. The method according to claim 1, wherein the variation of said physical parameter is measured before and after said injection step and wherein said step of identifying the optimum spatial distribution of the injection points is determined by considering that the volume of ground that is improved with said injection step corresponds to the volume of ground in which values of electrical resistivity at least 5% higher than those present in that same volume of ground before said injection step are observed.

4. The method according to claim 1, wherein said step of identifying the optimum spatial distribution of the injection points is determined by considering that the volume of ground improved with the injection corresponds to the volume of ground in which values of electrical resistivity that are higher than a predefined value are observed.

5. The method according to claim 1, further comprising a step of storing the amount of cement and/or synthetic mixture that is injected in said first step of injection, said amount of injected mixture corresponding to the amount of cement and/or synthetic mixture that is necessary in order to produce, in said injection step, a displacement of said built structure and/or overlying ground that is at least equal to 0.1 mm.

6. The method according to claim 5, wherein the amount of cement and/or synthetic mixture to be injected in the injection points identified in said identification step corresponds substantially to the amount injected in said injection step before said step of interrupting the injection.

7. The method according to claim 1, wherein said first step of detecting is carried out with one-dimensional laser systems, two-dimensional laser systems, or three-dimensional laser systems.

8. The method according to claim 1, wherein said first step of detecting is carried out with radar systems.

9. The method according to claim 1, wherein the injection step corresponds to an injection in a single injection point of cement and/or synthetic mixtures.

10. The method according to claim 1, wherein the injection step corresponds to multiple injections, which may or may not be simultaneous, of cement and/or synthetic mixtures distributed in a volume of ground.

11. The method according to claim 1, wherein said step of measuring the electrical resistivity of the ground after said injection step is carried out in a spherical neighborhood of the injection point with a radius of more than one meter.

12. The method according to claim 1, wherein the spatial distribution of the injection points is preset in the design phase, said step of identification of the optimum spatial distribution being suitable to determine the amount of cement and/or synthetic mixture to be injected in each point and/or to increase or decrease the injection points, creating ones or leaving some unused.

* * * * *